US006461454B2

(12) United States Patent
Tawara et al.

(10) Patent No.: US 6,461,454 B2
(45) Date of Patent: Oct. 8, 2002

(54) ALUMINUM ALLOY PLATE FOR AUTOMOBILE AND MANUFACTURING METHOD THEREOF

(75) Inventors: Makoto Tawara, Moka (JP); Osamu Takezoe, Moka (JP); Mariko Sakata, Kobe (JP); Shinji Matsuda, Fujisawa (JP); Masahito Katsukura, Isehara (JP); Tsutomu Hattori, Fujisawa (JP)

(73) Assignees: Kabushiki Kaisha Kobe Seiko Sho (Kobe Steel, Ltd.), Kobe (JP); Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 09/836,370

(22) Filed: Apr. 18, 2001

(65) Prior Publication Data

US 2002/0012605 A1 Jan. 31, 2002

(30) Foreign Application Priority Data

Apr. 20, 2000 (JP) ..... 2000-119715

(51) Int. Cl.[7] ..... C22C 21/08

(52) U.S. Cl. ..... 148/417; 420/534; 420/535; 428/610

(58) Field of Search ..... 148/417; 428/610; 420/534, 535

(56) References Cited

FOREIGN PATENT DOCUMENTS

| | | |
|---|---|---|
| JP | 6-2064 | 1/1994 |
| JP | 6-136478 | 5/1994 |
| JP | 6-287672 | 10/1994 |
| JP | 8-109428 | 4/1996 |
| JP | 9-202933 | 8/1997 |
| JP | 9-209068 | 8/1997 |

OTHER PUBLICATIONS

Masaaki Kurihara, et al.; "Corrosion Resistance of 6000 Series Alloys"; Lecture Abstract No. 99 of the 88$^{th}$ Meeting of Light Metal Society (edited in 1995).

Keitarou Yamaguchi, et al.; "The Effect of Zn Content on Susceptibility to Intergranular Corrosion of Al–Mg–Si–Cu Alloy"; Lecture Abstract No. 165 of the 92$^{nd}$ Meeting of Light Metal Society (edited in 1997).

*Primary Examiner*—George Wyszomierski
*Assistant Examiner*—Janelle Combs-Morillo
(74) *Attorney, Agent, or Firm*—Oblon, Spivak, McClelland, Maier & Neustadt, P.C.

(57) ABSTRACT

An aluminum alloy plate for an automobile has a chemical composition containing 0.8 to 1.5% by mass of Si, 0.4 to 0.7% by mass of Mg and 0.5 to 0.8% by mass of Cu. The crystal grain size is 10 to 40 $\mu$m. Cu content obtained by analyzing the outermost surface of the aluminum alloy with an oxide film according to X-ray photoelectron spectroscopy (XPS) is 1/10 to 1/2 of the Cu content of the bulk of the aluminum alloy plate.

13 Claims, No Drawings

ALUMINUM ALLOY PLATE FOR AUTOMOBILE AND MANUFACTURING METHOD THEREOF

BACKGROUND OF THE INVENTION

1. Field of the Invention

The present invention relates to an aluminum alloy plate for an automobile such as a panel used by being coated after a chemical conversion treatment and a manufacturing method thereof, and more particularly, relates to an aluminum alloy plate for an automobile made of Al—Mg—Si based aluminum alloy and having excellent filiform rust resistance and a manufacturing method thereof.

2. Description of the Related Art

The weight reduction of an automobile has been recently proceeded from the viewpoints of energy reduction, the control of exhausted gas and the like. Concerning the weight reduction of the automobile, it is studied to adopt an aluminum (Al) alloy plate in place of a steel plate, in addition to make the steel plate thinner.

The aluminum alloy plate for an automobile is generally formed into a predetermined member, a chemical conversion treatment such as zinc phosphate treatment or the like is carried out, and electro-deposition coating, intermediate coating and top coating are further carried out.

An Al alloy material such as A.A or JIS5000-base (hereinafter, referred to as 5000-base) excellent in formability, or A.A or JIS6000-base (hereinafter, referred to as 6000-base) excellent in formability and baking cure property is suitable for an aluminum panel such as the outer plate of an automobile, or the like, and in particular, the 6000-base Al alloy material has an excellent formability.

In order to adopt the Al alloy plate as a panel for transportation instruments, a press forming processing such as deep drawing, overhang, bending and elongating flange or the like is carried out to make the aluminum alloy plate be in a predetermined member form. In this case, it is required to secure high deep drawing property (the limit deep drawing ratio (LDR) is large, or the limit deep drawing height ($LDH_0$) is high) and high form-freezing (form-holding) property, in the deep drawing, overhang, bending and elongating flange forming.

Accordingly, it is carried out to control the chemical composition of the 6000-base Al alloy plate as means of improving the formability of the 6000-base Al alloy plate. In particular, the most effective means for improving the formability is the addition of Cu, and such a technique is disclosed in many Japanese Patent Application Laid-Open No.6-2064, No.6-136478, No.8-109428, No.9-209068, No.9-202933 and the like.

When Cu is added, the formability is surely improved, but a thread shape corrosion called as filiform rust is apt to be generated between a coating and the aluminum alloy plate after coating. As one of methods for suppressing such filiform rust, a technique in which the filiform rust is suppressed by preventing intergranular corrosion from occurring disclosed, under an assumption that there is a correlation between the intergranular corrosion of the aluminum alloy plate and the filiform rust (Conventional Example 1).

For example, a technique of suppressing the intergranular corrosion is disclosed in the Lecture Abstract No.99 (edited in 1995) of the $88^{th}$ Meeting of Light Metal Society. In this technique, $Mg_2Si$ is precipitated both in the grain boundary and in the grain by means of a precipitation process so as to make the intergranular potential and the transgranular potential be the same level each other.

In addition, a technique of suppressing the intergranular corrosion by making the transgranular potential be the same level as the dissolution potential of $Mg_2Si$ precipitated in the grain boundary by addition of Zn is disclosed in the Lecture Correction No.165 (edited in 1997) of the $92^{th}$ Meeting of Light Metal Society.

Further, as an alternative method, it is studied to improve phosphorous acid treatment property under an assumption that the filiform rust can be suppressed by improving the adhesion of a coating film with a chemical conversion treatment film such as a phosphate treatment film or the like. In JP-A No.6-287672, is disclosed a technique of improving the filiform rust property, by precipitating (concentrating) 0.1 to 10% by mass of Cu on a surface, by way of etching treatment and the like, of the 6000-base Al alloy plate containing 0.01 to 5% by mass of Cu, working the precipitated Cu as a cathode reaction point at a phosphorous acid treatment to improve phosphorous acid treatment property, and improving the adhesion of the Al alloy plate with the coating film (Conventional Example 2).

However, when the difference between the intergranular potential and transgranular potential is made smaller as the technique in Conventional Example 1, the intergranular corrosion property of the aluminum alloy plate is surely improved, but there is a problem that the formability of the aluminum alloy plate is lowered by the precipitation of the above-described $Mg_2Si$. Further, even if the precipitation treatment of $Mg_2Si$ is carried out, the filiform rust still happens, and there is a problem that the rust cannot be effectively suppressed.

Further, in the technique of Conventional Example 2, when Cu was concentrated on the surface of the aluminum alloy plate, the phosphate treatment property of the aluminum alloy plate is surely improved, and the adhesion property of the coating with the aluminum alloy plate treated with chemical conversion treatment is improved. However, there is a problem that the filiform rust resistance is remarkably lowered by having concentrated Cu on the surface. Accordingly, on the contrary, the technique of Conventional Example 2 in which Cu is concentrated on the aluminum alloy plate is reverse effect to improve the filiform rust property of the 6000-base aluminum alloy plate material containing Cu.

Thus, it is status quo that there has been no effective method of improving the filiform rust resistance of the 6000-base aluminum alloy material containing Cu which has remarkably high sensitivity for the generation of the filiform rust after coating.

SUMMARY OF THE INVENTION

The object of the present invention is to provide an aluminum alloy plate for an automobile containing Cu, which has an improved filiform rust resistance while keeping high formability and, and a manufacturing method thereof.

The aluminum alloy plate for an automobile according to the present invention has a chemical composition containing 0.8 to 1.5% by mass of Si, 0.4 to 0.7% by mass of Mg and 0.5 to 0.8% by mass of Cu. The crystal grain size of the aluminum alloy plate is 10 to 40 $\mu$m, and Cu content obtained by analyzing the outermost surface of the aluminum alloy plate with an oxide film according to X-ray photoelectron spectroscopy (XPS) is 1/10 to 1/2 of the Cu content of the bulk of said aluminum alloy plate.

The manufacturing method of the aluminum alloy plate for an automobile according to the present invention comprises the steps of: melting and casting the ingot of an aluminum alloy plate containing 0.8 to 1.5% by mass of Si, 0.4 to 0.7% by mass of Mg and 0.5 to 0.8% by mass of Cu according to a DC casting method and homogenizing; carrying out hot rolling, cold rolling and annealing to obtain a plate of a predetermined thickness; and rapidly cooling after carrying out solution heat treatment during a predetermined time in a heat treatment furnace.

In the present invention, since the contents of Cu, Mg and Si in the Al alloy, the crystal grain size of the Al alloy, and Cu content on the outermost surface are appropriately defined, the aluminum alloy plate for an automobile which has a high filiform rust resistance while keeping high formability and is further excellent in appearance after zinc phosphate treatment, baking cure property and productivity, can be obtained.

DETAILED DESCRIPTION OF THE PREFERRED EMBODIMENT

The present invention is further described in detail below. The inventors of the present invention have intensively studied and conducted experiments in order to solve the above-mentioned problems, and as a result, found that the crystal grain size and the Cu content on the outermost surface of the Al alloy plate with an oxide film are important factors of generating the filiform rust of the 6000-base aluminum alloy plate containing Cu and greatly influence on the filiform rust resistance of the Al alloy plate, and further, found that the high filiform rust resistance can be obtained while keeping good formability by setting chemical compositions in an appropriate range.

The aluminum alloy plate for an automobile of the present invention has a composition containing 0.8 to 1.5% by mass of Si, 0.4 to 0.7% by mass of Mg and 0.5 to 0.8% by mass of Cu. The crystal grain size is 10 to 40 $\mu$m, and Cu content obtained by analyzing the outermost surface of the aluminum alloy plate with an oxide film according to X-ray photoelectron spectroscopy (XPS) is 1/10 to 1/2 of the Cu content of the bulk of said aluminum alloy plate.

Next, the reason why the values of the aluminum alloy plate for an automobile according to the present invention are limited will be described below.

Si Content: 0.8 to 1.5% by Mass

Si is precipitated as $Mg_2Si$ together with Mg by an artificial aging process, and an essential element for imparting high strength (proof stress) at use. However, when the content of Si is less than 0.8% by mass, adequate strength is not obtained even though the artificial aging process is carried out. On the other hand, when the content of Si exceeds 1.5% by mass, formability is obstructed because Si is precipitated as coarse particle at the time of casting and baking and elongation is deteriorated and the like. Accordingly, the content of Si is set as 0.8 to 1.5% by mass.

Mg Content: 0.4 to 0.7% by Mass

Mg is precipitated as $Mg_2Si$ together with Si by the artificial aging process (forming, and baking cure treatment after coating, etc.), and is an essential element for imparting high strength (proof stress) at use and baking cure hardening property by further forming a compound layer containing Mg, Cu and Al in an aluminum alloy plate containing Cu. However, when the content is less than 0.4% by mass, baking cure hardening property at the time of coating is lowered, and it cannot endure shear deformation when it is subject to press forming and bending processing, therefore crack happens to occur. Further, adequate strength is not obtained even though the artificial aging process is carried out. On the other hand, when the Mg content exceeds 0.7% by mass, strength (proof stress) becomes too high, therefore the formability is obstructed. Accordingly, the content of Mg is set as 0.4 to 0.7% by mass.

Cu Content: 0.5 to 0.8% by Mass

Cu forms or is precipitated as a compound with Mg and Al at the time of baking and heating, and has an effect for improving formability in a solid solution condition at T4 quality adjustment process together with an effect for imparting precipitation cure hardening property. However, when the Cu content is less than 0.5% by mass, these effects are little. On the other hand, when the Cu content exceeds 0.8% by mass, the effects are saturated, a large amount of Cu is precipitated (concentrated) on the surface of the Al alloy plate when the Al alloy plate is washed with alkali solution and the like, and the filiform rust resistance of the Al alloy plate is deteriorated. Accordingly, the content of Cu is set as 0.5 to 0.8% by mass.

Further, in the present invention, the contents of Mg, Si and Cu are defined as the essential components, but for example, Mn, Fe, Ti, Cr or Zn or the like may be contained as a component other than the above if they are within the range not damaging the object of the present invention. For example, 0.2% by mass or less in case of Mn, 0.3% by mass or less in case of Fe, 0.1% by mass or less in case of Ti, 0.1% by mass or less in case of Cr, and 0.2% by mass or less in case of Zn may be contained.

Crystal Grain Size of Al Alloy Plate: 10 to 40 $\mu$m

There is a correlation between the filiform rust of the Al alloy plate and the intergranular corrosion of the crystal grain. Namely, when the crystal grain size of the aluminum alloy plate is too large, corrosion reaction is apt to be concentrated on one grain boundary, the proceeding to depth direction of intergranular corrosion is accelerated, and further, when the proceeding of intergranular corrosion is accelerated, the filiform rust resistance is remarkably deteriorated. On the other hand, when the crystal grain size is small, the corrosion reaction is dispersed, the proceeding to depth direction of intergranular corrosion is suppressed, and the filiform rust resistance is improved.

In the present invention, the proceeding of intergranular corrosion is designed to be suppressed by suppressing the crystal grain size of the aluminum alloy plate, and specifically, the crystal grain size of the aluminum alloy plate is set as 10 to 40 $\mu$m. When the crystal grain size exceeds 40 $\mu$m, the formability is lowered, and the filiform rust resistance is also lowered. On the other hand, when the crystal grain size is less than 10 $\mu$m, the manufacturing efficiency of the aluminum alloy plate is lowered and the filiform rust resistance is saturated. Accordingly, the crystal grain size is set as 10 to 40 $\mu$m.

The crystal grain size was measured by the procedure described below according to so called intercept method. Firstly, a sectional micro photograph to a rolling direction of the plate and a sectional micro photograph to a direction orthogonal to the rolling direction were respectively photographed at a magnification of 100. Lines respectively elongated in a vertical and horizontal direction and having vertical and horizontal lengths of L1 and L2 were arbitrarily drawn on these photographs. Then, the number of grains which exist on the lines having lengths of L1 and L2 are respectively measured as n1 and n2, average particle diameters are determined by the following equation (1), the average value of the average particle diameters determined from the respective sectional micro photos was calculated as the crystal grain size. Further, the size of the average particle diameters does not depend on the lengths of L1 and L2.

$$\text{Average particle diameter}=(L1+L2)/(n1+n2) \quad (1)$$

Cu content obtained by analyzing the outermost surface of the aluminum alloy plate with an oxide film according to X-ray Photoelectron Spectroscopy (XPS) is 1/10 to 1/2 of the Cu content of the bulk of the aluminum alloy plate.

In the present invention, the Cu content of the outermost surface portion of the aluminum alloy plate is defined. The Cu content of the outermost surface portion is an amount of Cu detected by analysis of X-ray photoelectron spectroscopy (XPS) which is called as ESCA (Electron Spectroscopy for Chemical Analysis), and in the present invention, the ratio of the Cu content (atom %) of the outermost surface of the aluminum alloy plate to the Cu content (atom %) of the aluminum alloy material (mother material) is set as 1/10 to 1/2.

Further, the reason why the outermost surface portion of the aluminum alloy plate was set to the outermost surface of the aluminum alloy plate with an oxide film in the present invention is to include the following both cases in the present invention. Because the oxide film is usually formed on the surface of the aluminum alloy plate, but the thickness of the oxide film differs depending on manufacturing conditions, the Cu content of the surface of the aluminum alloy plate is measured when the oxide film is thin, and the Cu content in the oxide film is measured when the oxide film is thick. The present invention includes the both cases where the Cu content of the surface of the aluminum alloy plate and the Cu content of the oxide film are measured.

An argon gas etching equipment is used for measurement of XPS of the present invention, etching is carried out at an etching rate of 50 Å/min., and the Cu content was detected at times of 10, 20 and 30 seconds after start of etching. Thus, the Cu contents are measured at three different points of depth being different in the thickness direction of the aluminum alloy plate with the oxide film, and the average value of these Cu contents was defined as the Cu content at the outermost surface.

Cu concentrated to the surface of the aluminum alloy plate works as a radix point of cathode reaction at phosphate treatment. Although the phosphate treatment is surely improved, Cu remains also inevitably on the surface of the aluminum alloy plate after the phosphate treatment and coating, and the Cu on the surface remarkably deteriorates the filiform rust resistance.

When the Cu content of the outermost surface of the aluminum alloy plate is larger than 1/2 of the Cu content of the bulk of the aluminum alloy plate (mother material), the sensitivity for generation of filiform rust after coating of the aluminum alloy plate becomes high, and the filiform rust resistance is remarkably lowered. On the other hand, when the Cu content of the outermost surface portion of the aluminum alloy plate is smaller than 1/10 of the Cu content of the bulk of the aluminum alloy plate (mother material), unevenness in zinc phosphate treatment is generated, therefore the filiform rust resistance of the aluminum alloy plate coated is lowered. Accordingly, the Cu content of the outermost surface of the aluminum alloy plate with the oxide film obtained by analyzing according to XPS is set as 1/10 to 1/2 of the Cu content of the bulk of the aluminum alloy material (mother material), and more preferably 1/9 to 1/3.

Then, the manufacturing method of the aluminum alloy plate for an automobile of the present invention will be described. Firstly, the ingot of an aluminum alloy containing 0.8 to 1.5% by mass of Si, 0.4 to 0.7% by mass of Mg and 0.5 to 0.8% by mass of Cu is prepared by melting and casting according to a DC casting method. Then, after carrying out homogenization treatment, hot rolling is carried out to, for example, a thickness of 2.0 to 10.0 mm, then cold rolling is carried out to, for example, a thickness of 1.0 mm, and annealing treatment is carried out. Further, the cold rolling rate is 50 to 90%. Then, solution heat treatment is carried out, for example, at a temperature of 500° C. or more for several seconds in a continuous heat treatment furnace, and for example, water cooling or the like is carried out to rapidly cool the plate. The aluminum alloy plate is washed with a degreasing agent or the like after cooling, treated with phosphate treatment, then coated and processed to a panel for an automobile and the like. The crystal grain size of the aluminum alloy plate can be controlled at 10 to 40 μm by appropriately controlling a temperature and a rolling rate at hot rolling, an annealing condition, and a cold rolling rate, and the like in accordance with the composition of the aluminum alloy. Further, the Cu content on the surface of the aluminum alloy plate can be controlled by changing a washing condition (for example, washing temperature, etc.) after carrying out solution heat treatment and cooling.

EXAMPLE

Then, concerning Examples of the present invention, the effect is described in comparison with Comparative Examples deviated from the scope of claim of the present invention.

Firstly, after melting the ingot of an aluminum alloy shown in Table 1 described below according to DC casting method, the surface of the ingot was shaved, then homogenization treatment was carried out at a temperature of 520° C. for 4 hours, and successively hot rolling was carried out at a stating temperature of 520° C. and a hot rolling rate of 99%. Then, cold rolling was carried out at a cold rolling rate of 75%, successively heating was carried out at a heating rate of 400° C./min. to be retained at a reaching temperature of 520° C. for 5 seconds or less, then rapid cooling was carried out at 800° C./min. to a normal temperature, and an aluminum alloy plate was prepared. The aluminum alloy plates in Examples 1 to 5 and Comparative Examples 8 to 15 were washed for 10 to 15 seconds using an alkaline washing liquid having a pH of 10 and a temperature of 30° C. Further, Comparative Example 6 was washed for 5 seconds using an alkaline washing liquid having a pH of 10 and a temperature of 20° C. Comparative Example 7 was washed for 30 seconds using an alkaline washing liquid having a pH of 12 and a temperature of 60° C. The average value of the Cu contents (atom %) of the surface layers of these examples and comparative examples was measured by XPS according to the above-mentioned method, and the ratio of the Cu content (atom %) of the surface layer to the Cu content (atom %) of the bulk was determined.

Further, the crystal grain size of the examples and the comparative examples was measured according to the intercept method as described above. The measurement results of (Cu content of surface layer portion of aluminum alloy material (example)/Cu content of the bulk of the aluminum alloy material (example)) and the crystal grain size are shown in Table 1 described below.

Then, concerning these examples and comparative examples, the evaluation of appearance after zinc phosphate treatment, the evaluation of the filiform rust resistance, the evaluation of the formability, the evaluation of the BH property (baking cure property), and the evaluation of productivity were carried out.

Concerning the evaluation of appearance after zinc phosphate treatment, after these examples and comparative examples were immersed in a zinc phosphate bath which contains 150 ppm of free fluorine and the zinc phosphate treatment was carried out, the appearance of the respective examples and comparative examples after the zinc phosphate treatment was observed, and those having no unevenness were evaluated as ○ and those having unevenness were evaluated as ×.

Then, cationic electro-deposition coating was carried out on the examples and the comparative examples on which zinc phosphate coating was provided, and the evaluation test of the filiform rust resistance was carried out for these examples and the comparative examples on which zinc phosphate coating was provided. In the evaluation test of the filiform rust resistance, after a scratch having a length of 5 cm was treated on the surface of the test pieces of the aluminum alloy plate coated, 5% by mass of NaCl aqueous solution having a temperature of 35° C. was sprayed for 24 hours against these test pieces, then they were stood alone for 1000 hours in atmosphere of constant temperature and constant moisture having a temperature of 40° C. and a moisture of 80 to 85%, and the maximum length L of the filiform rusts generated was measured. Concerning the maximum length L (mm) of the filiform rusts, the length of a line which was perpendicular to the scratch and drawn from the edge of rusts to the scratch was measured, because the rust was generated from the scratch as a radix point. The longest length of the rust in the perpendicular direction to the scratch was referred to as the maximum length L. Further, it was evaluated as ⊚ that the maximum length L is $L \leqq 1.0$, $1.0 < L \leqq 2.0$ as ○, $2.0 < L \leqq 3.0$ as Δ, and $3.0 < L$ as ×.

The evaluation of the formability was carried out by carrying out Erichsen test of the aluminum alloy plate of the examples and comparative examples. Those having an Erichsen value of 10 mm or more were evaluated as ○, and those having an Erichsen value of less than 10 mm were evaluated as ×.

As the evaluation of the BH property, the proof stresses of the examples and the comparative examples were measured by carrying out heating treatment (baking) at 170° C. for 20 min. after stretching of 2%. Then, those having a proof stress of 190N/mm$^2$ or more were evaluated as ○, and those having a proof stress of less than 190N/mm$^2$ were evaluated as ×.

As the evaluation of manufacturing efficiency, those having the crystal grain size of μm or more were evaluated as ○, and those having the crystal grain size of less than 10 μm were evaluated as ×.

TABLE 1

| | No. | Chemical component of Al alloy plate (% by mass) Si | Cu | Mg | Crystal grain size of Al alloy plate (μm) | Cu content of surface layer portion/ Cu content of alloy plate |
|---|---|---|---|---|---|---|
| Example | 1 | 0.9 | 0.55 | 0.65 | 35 | 1/9 |
| | 2 | 1.4 | 0.75 | 0.45 | 15 | 1/9 |
| | 3 | 1.40 | 0.75 | 0.45 | 15 | 1/3 |
| | 4 | 1.15 | 0.55 | 0.55 | 15 | 1/3 |
| | 5 | 1.15 | 0.75 | 0.55 | 35 | 1/2 |
| Comparative Example | 6 | 0.90 | 0.55 | 0.65 | 35 | 1/12 |
| | 7 | 1.40 | 0.75 | 0.45 | 15 | 1/1 |
| | 8 | 1.40 | 0.55 | 0.45 | 45 | 1/6 |
| | 9 | 0.90 | 0.75 | 0.65 | 7 | 1/6 |
| | 10 | 1.15 | 0.55 | 0.75 | 25 | 1/6 |
| | 11 | 1.15 | 0.75 | 0.35 | 25 | 1/6 |
| | 12 | 1.60 | 0.55 | 0.55 | 25 | 1/6 |
| | 13 | 0.70 | 0.75 | 0.55 | 25 | 1/6 |
| | 14 | 0.90 | 0.45 | 0.65 | 25 | 1/6 |
| | 15 | 1.40 | 0.85 | 0.45 | 25 | 1/6 |

TABLE 2

| | No. | Appearance after zinc phosphate treatment | Filiform rust resistance of aluminum alloy coated plate | Formability of aluminum alloy plate | BH property of aluminum alloy plate | Productivity of aluminum alloy plate |
|---|---|---|---|---|---|---|
| Example | 1 | ○ | ⊚ | ○ | ○ | ○ |
| | 2 | ○ | ⊚ | ○ | ○ | ○ |
| | 3 | ○ | ⊚ | ○ | ○ | ○ |
| | 4 | ○ | ⊚ | ○ | ○ | ○ |
| | 5 | ○ | ○ | ○ | ○ | ○ |
| Comparative Example | 6 | X | Δ | ○ | ○ | ○ |
| | 7 | ○ | X | ○ | ○ | ○ |
| | 8 | ○ | X | X | ○ | ○ |
| | 9 | ○ | ○ | ○ | ○ | X |
| | 10 | ○ | ○ | X | ○ | ○ |
| | 11 | ○ | ○ | ○ | X | ○ |
| | 12 | ○ | ○ | X | ○ | ○ |
| | 13 | ○ | ○ | X | ○ | ○ |
| | 14 | ○ | ○ | X | ○ | ○ |
| | 15 | ○ | X | ○ | ○ | ○ |

Since the chemical composition of the Al alloy plate, the crystal grain size, and the Cu content of the outermost surface of the Al alloy plate to Cu content of the bulk of the Al alloy plate in Examples 1 to 5 are within the range defined in the present invention, all of the evaluation of appearance after zinc phosphate treatment, the evaluation of the filiform rust resistance, the evaluation of the formability, the evaluation of the BH property, and the manufacturing efficiency were good. Since the Cu content of the outermost surface of the Al alloy plate to Cu content of the bulk of the Al alloy plate in Examples 1 to 4 are within the preferable range of the present invention, the filiform rust resistance was extremely excellent.

Since in Comparative Example 6, the Cu content of the outermost surface was less than the lowest limit of the range prescribed in the present invention because of insufficient washing, the surface was not homogeneous, unevenness was generated in the zinc phosphate treatment, and the filiform rust resistance was lowered.

Since in Comparative Example 7, the Cu content of the outermost surface exceeds the uppermost limit of the range prescribed in the present invention, the Cu was concentrated on the surface, and the filiform rust resistance was deteriorated.

Since in Comparative Example 8, the crystal grain size exceeds the uppermost limit of the range prescribed in the present invention, the formability and the filiform rust resistance were lowered, and since in Comparative Example 9, the crystal grain size was less than the lowest limit of the range prescribed in the present invention, the formability and the filiform rust resistance were good but the productivity was lowered.

Since in Comparative Example 10, Mg content exceeds the uppermost limit of the range prescribed in the present invention, the formability was lowered. Further, since in Comparative Example 12, Si content exceeds the uppermost limit of the range prescribed in the present invention, the formability was lowered. Further, since in Comparative Example 11, Mg content was less than the lowest limit of the range prescribed in the present invention, the BH property is low. Furthermore, since in Comparative Example 13 and Comparative Example 14, Si content and Cu content were respectively less than the lowest limit of the range prescribed in the present invention, the formability was lowered. Since in Comparative Example 15, Cu content exceeds the uppermost limit of the range prescribed in the present invention, the filiform rust resistance was lowered.

What is claimed is:

1. An aluminum alloy plate for an automobile having a chemical composition containing 0.8 to 1.5% by mass of Si, 0.4 to 0.7% by mass of Mg and 0.5 to 0.8% by mass of Cu, and a crystal grain size of 10 to 40 $\mu$m, and Cu content obtained by analyzing the outermost surface of the aluminum alloy plate with an oxide film according to X-ray photoelectron spectroscopy (XPS) being 1/10 to 1/2 of the Cu content of the bulk of the aluminum alloy plate.

2. The aluminum alloy plate according to claim 1, further comprising from 0–0.2% by mass of Mn.

3. The aluminum alloy plate according to claim 1, further comprising from 0–0.3% by mass of Fe.

4. The aluminum alloy plate according to claim 1, further comprising from 0–0.1% by mass of Ti.

5. The aluminum alloy plate according to claim 1, further comprising from 0–0.1% by mass of Cr.

6. The aluminum alloy plate according to claim 1, further comprising from 0–0.2% by mass of Zn.

7. The aluminum alloy plate according to claim 1, wherein the Cu content at the outermost surface is from 1/6 to 1/3 of the Cu content of bulk of the aluminum ally plate.

8. The aluminum alloy plate according to claim 1, comprising a chemical composition containing 0.9% by mass of Si, 0.55% by mass of Cu, and 0.65% by mass of Mg.

9. The aluminum alloy plate according to claim 1, comprising a chemical composition containing 1.4% by mass of Si, 0.75% by mass of Cu, and 0.45% by mass of Mg.

10. The aluminum alloy plate according to claim 1, comprising a chemical composition containing 1.15% by mass of Si, 0.55% by mass of Cu, and 0.55% by mass of Mg.

11. The aluminum alloy plate according to claim 1, comprising a chemical composition containing 1.15% by mass of Si, 0.75% by mass of Cu, and 0.55% by mass of Mg.

12. The aluminum alloy plate according to claim 1, wherein the crystal grain size is 35 centimeters.

13. The aluminum alloy plate according to claim 1, wherein the crystal grain size is 15 micrometers.

* * * * *